US010711516B2

(12) United States Patent
Vanek

(10) Patent No.: US 10,711,516 B2
(45) Date of Patent: Jul. 14, 2020

(54) DOOR AND PACKAGE RECEIVING ASSEMBLY COMBINATION

(71) Applicant: Nicholas Alexander Vanek, Prior Lake, MN (US)

(72) Inventor: Nicholas Alexander Vanek, Prior Lake, MN (US)

( * ) Notice: Subject to any disclaimer, the term of this patent is extended or adjusted under 35 U.S.C. 154(b) by 160 days.

(21) Appl. No.: 16/104,666

(22) Filed: Aug. 17, 2018

(65) Prior Publication Data

US 2019/0316411 A1 Oct. 17, 2019

Related U.S. Application Data

(60) Provisional application No. 62/656,891, filed on Apr. 12, 2018.

(51) Int. Cl.

| | |
|---|---|
| ***E06B 7/32*** | (2006.01) |
| ***A47G 29/22*** | (2006.01) |
| ***A47G 29/28*** | (2006.01) |

(52) U.S. Cl.

CPC ..... *E06B 7/32* (2013.01); *A47G 29/22* (2013.01); *A47G 29/28* (2013.01)

(58) Field of Classification Search

CPC ..... E06B 7/32; A47G 29/14; A47G 29/22; A47G 29/28

See application file for complete search history.

(56) References Cited

U.S. PATENT DOCUMENTS

| | | | | | |
|---|---|---|---|---|---|
| 496,243 | A * | 4/1893 | Zenner | B65F 1/02 | 220/479 |
| 840,751 | A * | 1/1907 | Cook | E06B 7/32 | 160/180 |
| 975,749 | A * | 11/1910 | Christy | E06B 7/32 | 49/168 |
| 1,222,966 | A * | 4/1917 | Matchette | A47G 29/14 | 232/43.4 |
| 1,408,840 | A * | 3/1922 | Sporer | A47G 29/22 | 232/42 |
| 1,671,611 | A * | 5/1928 | Rossman | A47G 29/14 | 232/43.4 |

(Continued)

FOREIGN PATENT DOCUMENTS

| | | |
|---|---|---|
| CN | 107028469 | 8/2017 |
| CN | 206737770 | 12/2017 |

(Continued)

*Primary Examiner* — Catherine A Kelly

(57) ABSTRACT

A door and package receiving assembly combination includes a door having an opening extending therethrough. A covering is attached to the door and closes the opening. The covering includes a lower panel pivotally coupled to the door that is positionable in vertical position covering the opening or in an angled position exposing the opening. The lower panel forms a chute for sliding packages down the lower panel and through the opening. A closing panel is attached to the door and is downwardly moved to closed position covering the opening or upwardly moved to an open position exposing the opening. A linkage is attached to the closing panel and the lower panel. The linkage lowers the closing panel to the closed position as the lower panel is moved to the angled position and lifts the closing panel to the open position as the lower panel is moved to the vertical position.

9 Claims, 7 Drawing Sheets

(56) References Cited

U.S. PATENT DOCUMENTS

| | | | | | |
|---|---|---|---|---|---|
| 1,674,483 | A * | 6/1928 | Sammis | A47G 29/22 | 232/41 R |
| 1,738,539 | A * | 12/1929 | Moss | E06B 7/32 | 232/1 E |
| 1,810,784 | A * | 6/1931 | Pavelka | B65F 1/0093 | 220/476 |
| 3,976,345 | A * | 8/1976 | Walters | A47G 29/22 | 312/333 |
| 4,084,518 | A * | 4/1978 | Carlson | E06B 7/32 | 109/19 |
| 4,245,776 | A * | 1/1981 | Miner | E06B 7/32 | 232/43.3 |
| 4,297,812 | A | 11/1981 | McPhail | | |
| 7,246,562 | B2 * | 7/2007 | Lee | E06B 7/32 | 108/167 |
| 8,740,056 | B2 * | 6/2014 | Skouboe | A47G 29/16 | 232/45 |
| 8,960,530 | B2 | 2/2015 | Silke | | |
| 9,926,737 | B2 | 3/2018 | Wanjohi | | |
| 10,026,054 | B1 * | 7/2018 | Staton | B65D 25/00 | |
| 10,549,926 | B2 * | 2/2020 | Cano Coscia | B65G 47/74 | |
| 2003/0006275 | A1 * | 1/2003 | Gray | A47G 29/14 | 232/19 |

FOREIGN PATENT DOCUMENTS

| | | | | |
|---|---|---|---|---|
| DE | 19708262 | A1 * | 9/1998 | E06B 7/32 |
| EP | 0922423 | | 6/1999 | |
| EP | 2289376 | A1 * | 2/2011 | |
| FR | 23361 | E * | 11/1921 | A47G 29/28 |
| FR | 1246287 | A * | 11/1960 | E06B 7/32 |
| FR | 2616130 | A1 * | 12/1988 | A47G 29/22 |
| FR | 2644203 | A1 * | 9/1990 | E06B 7/32 |
| GB | 118214 | A * | 8/1918 | A47G 29/14 |
| GB | 336850 | A * | 10/1930 | A47G 29/28 |
| JP | 2000130045 | | 5/2000 | |
| JP | 20042254499 | | 8/2003 | |
| JP | 2017217453 | | 12/2017 | |
| WO | WO2012156659 | | 11/2012 | |

* cited by examiner

DOOR AND PACKAGE RECEIVING ASSEMBLY COMBINATION

CROSS-REFERENCE TO RELATED APPLICATIONS

I hereby claim the benefit under 35 U.S.C. Section 119(e) of U.S. Provisional application 62/656,891 filed Apr. 12, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to door with package pass-through mechanisms and more particularly pertains to a new door with package pass-through mechanism for allowing for secure receipt of a package through a dwelling or office door.

BRIEF SUMMARY OF THE INVENTION

An embodiment of the disclosure meets the needs presented above by generally comprising a door that has a front side and a back side. The door has an opening extending therein extending through the front and back sides. The opening has an upper edge, a lower edge, a first side edge and a second side edge. A covering is attached to the door and closes the opening. The covering includes a lower panel pivotally coupled to the door adjacent to the lower edge. The lower panel is positionable in vertical position covering the opening or in an angled position exposing the opening. The lower panel is angled to form a chute for sliding packages down the lower panel and through the opening when the lower panel is in the angled position. A closing panel is slidably attached to the door and is downwardly movable to closed position covering the opening or upwardly movable to an open position exposing the opening. A linkage is attached to the closing panel and the lower panel. The linkage lowers the closing panel to the closed position as the lower panel is moved to the angled position and lifts the closing panel to the open position as the lower panel is moved to the vertical position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
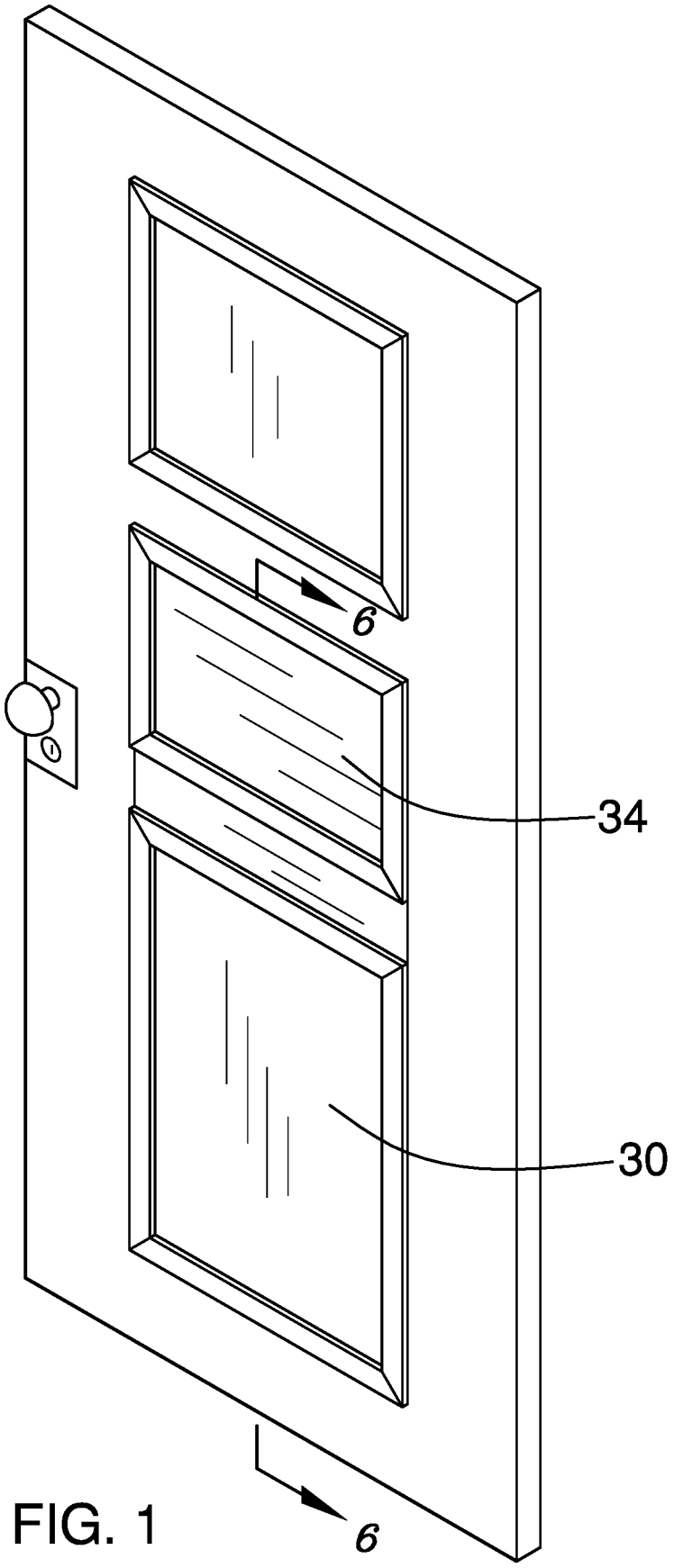
FIG. 1 is a front isometric view of a door and package receiving assembly combination according to an embodiment of the disclosure.

With reference now to the drawings, and in particular to FIGS. 1 through 8 thereof, a new door with package pass-through mechanism embodying the principles and concepts of an embodiment of the disclosure and generally designated by the reference numeral 10 will be described.

As best illustrated in FIGS. 1 through 8, the door and package receiving assembly combination 10 generally comprises a generally conventional door 12 having a front side 14 and a back side 16. While the door 12 may comprise any door, the door will typically be a door utilized for entry into a home dwelling, office space or the like which is typically locked when not in use and to restrict entry. As the door 12 may comprise an exterior door to a home, the door 12 may include sound and thermal insulation features common to those types of doors. The door 12 has an opening 18 extending therein extending through the front 14 and back 16 sides. The opening 18 has an upper edge 20, a lower edge 22, a first side edge 24 and a second side edge 26.

A covering 28 is attached to the door 12 to close the opening 18. The covering 12 includes a lower panel 30 that is pivotally coupled to the door 12 adjacent to the lower edge 22. This may be accomplished in any conventional manner including, for example, hinges or laterally extending spindles attaching the lower panel 30 to the door 12. The lower panel 30 is positionable in vertical position covering the opening 18 or in an angled position exposing the opening 18. The lower panel 30 may include an insert 32 to generally fill the opening 18 from the front side 14 to the back side 16 for both aesthetic and insulating purposes. The lower panel 30, when angled, forms a chute for sliding packages 70 down the lower panel 30 through the opening 18 and into the dwelling.

Figure 7:
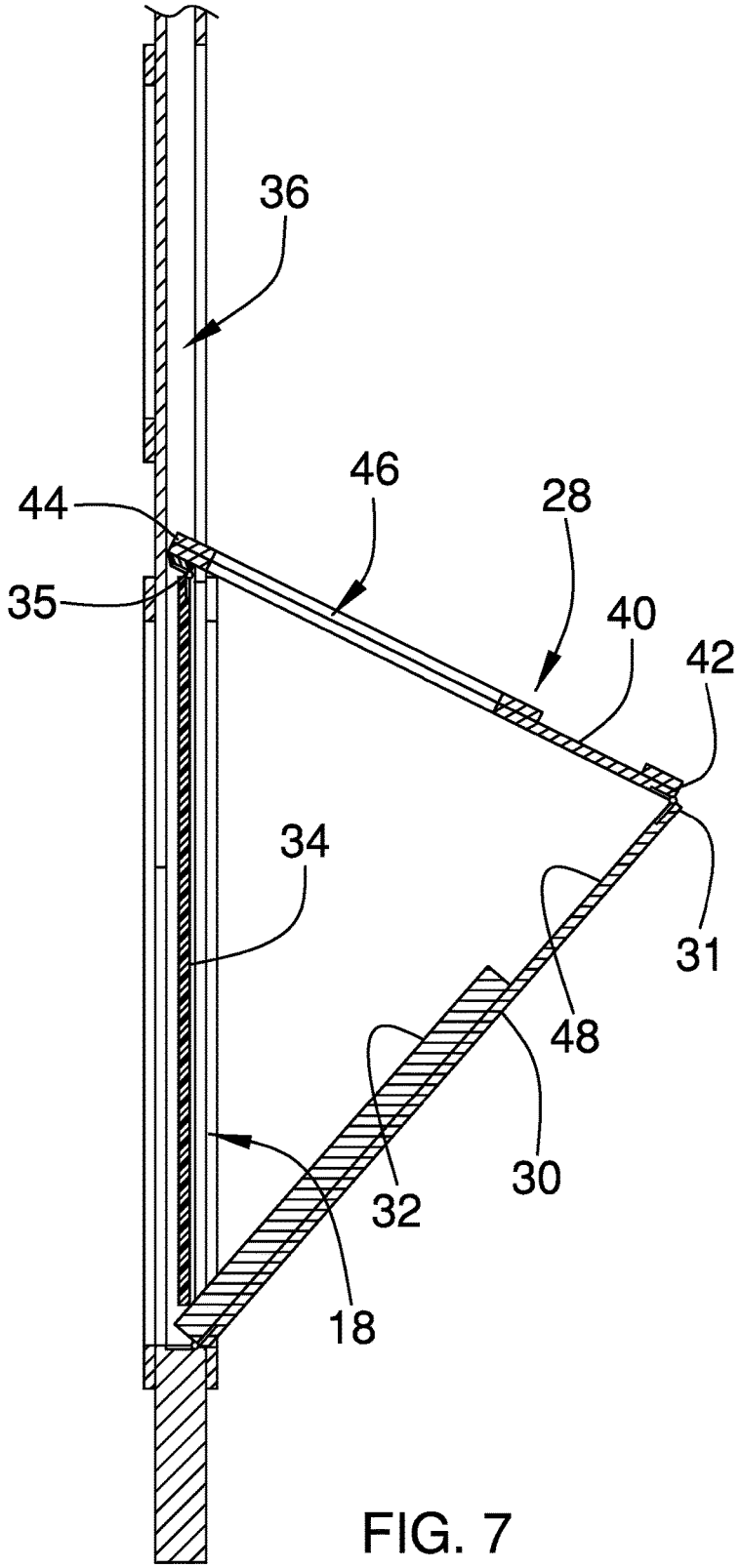
FIG. 7 is a cross-sectional view of an embodiment of the disclosure taken along line 7-7 of FIG. 2.

The covering 28 further includes a closing panel 34 that is slidably attached to the door 12 and is downwardly movable to closed position covering the opening 18 or upwardly movable to an open position exposing the opening 18. FIG. 7 depicts the closing panel as being exposed through the opening 18 on the front side 14 of the door 12 through a front orifice 36 in communication with and positioned above the opening 18. However, it should be understood that the front orifice 36 need not be used for reasons which will be described below.

Figure 2:
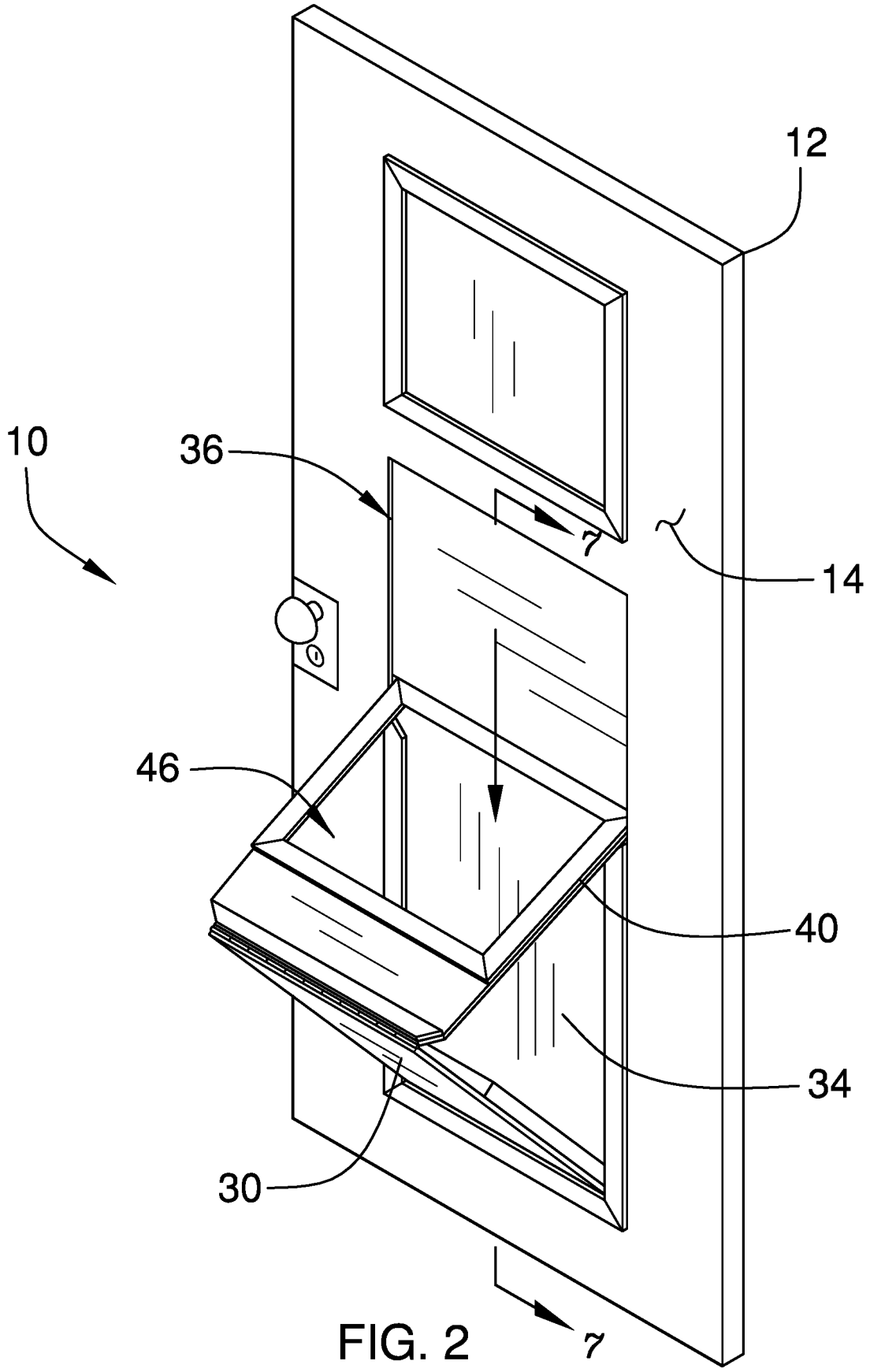
FIG. 2 is a front isometric view of an embodiment of the disclosure.
Figure 3:
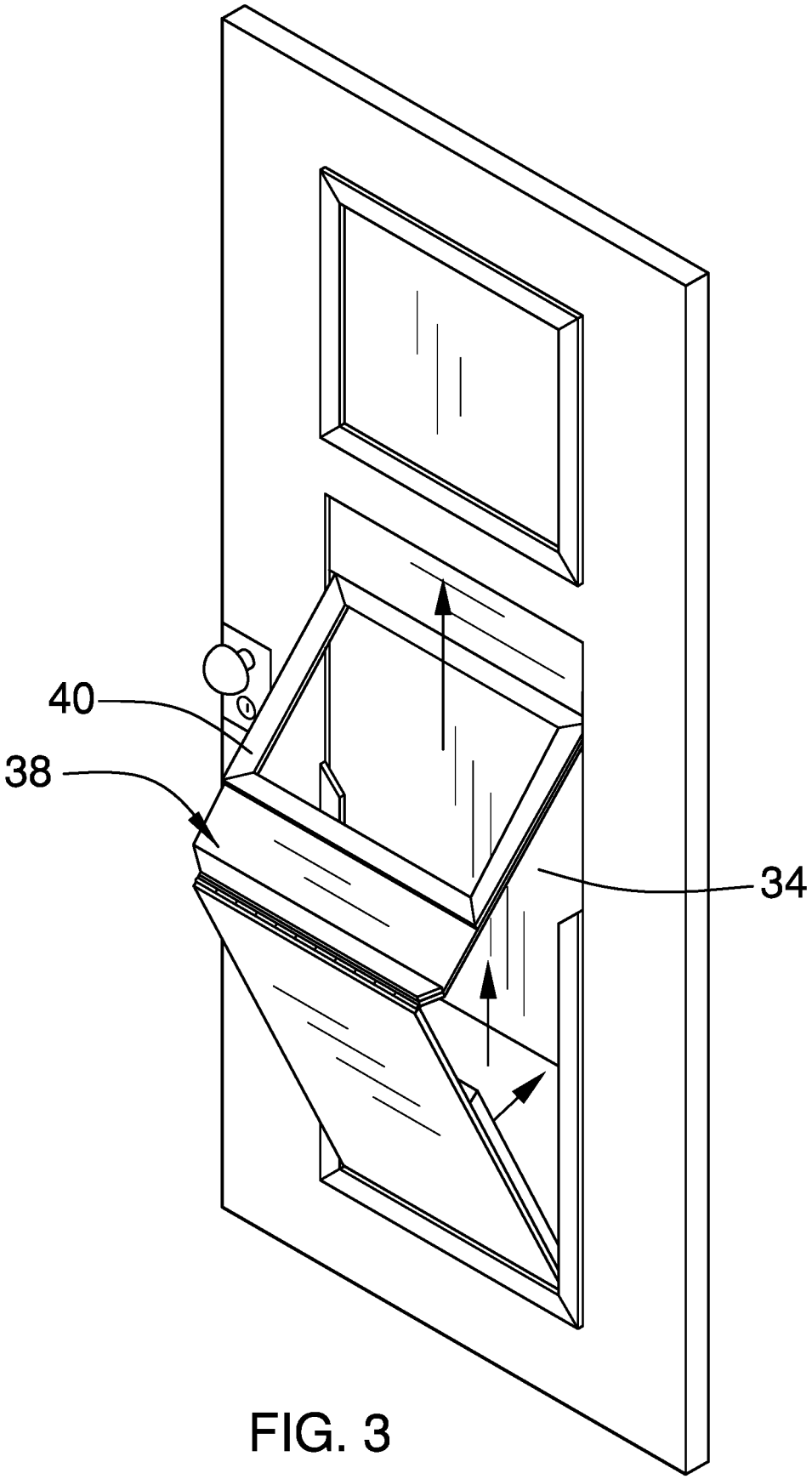
FIG. 3 is a front isometric view of an embodiment of the disclosure.
Figure 4:
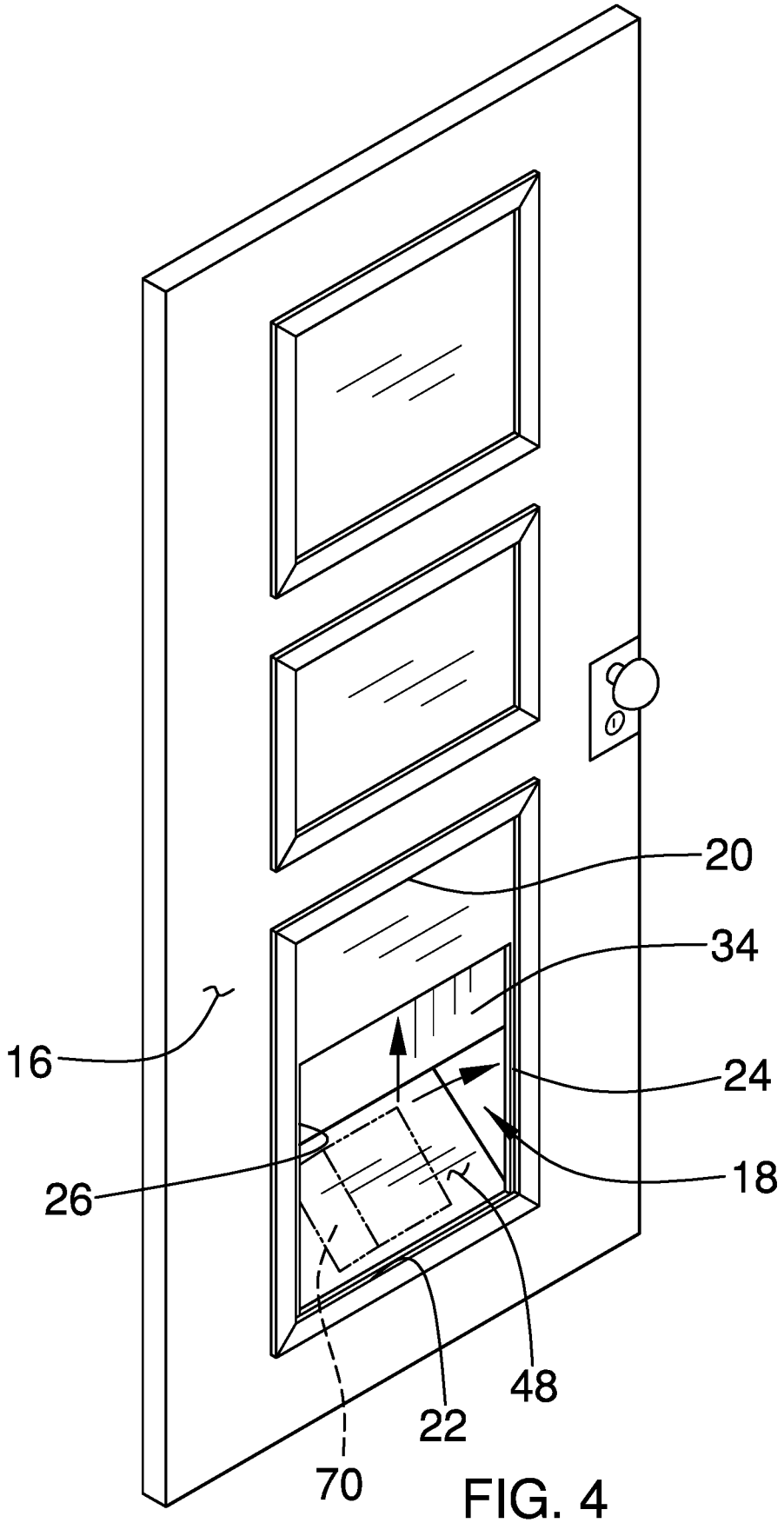
FIG. 4 is a rear isometric view of an embodiment of the disclosure.
Figure 5:
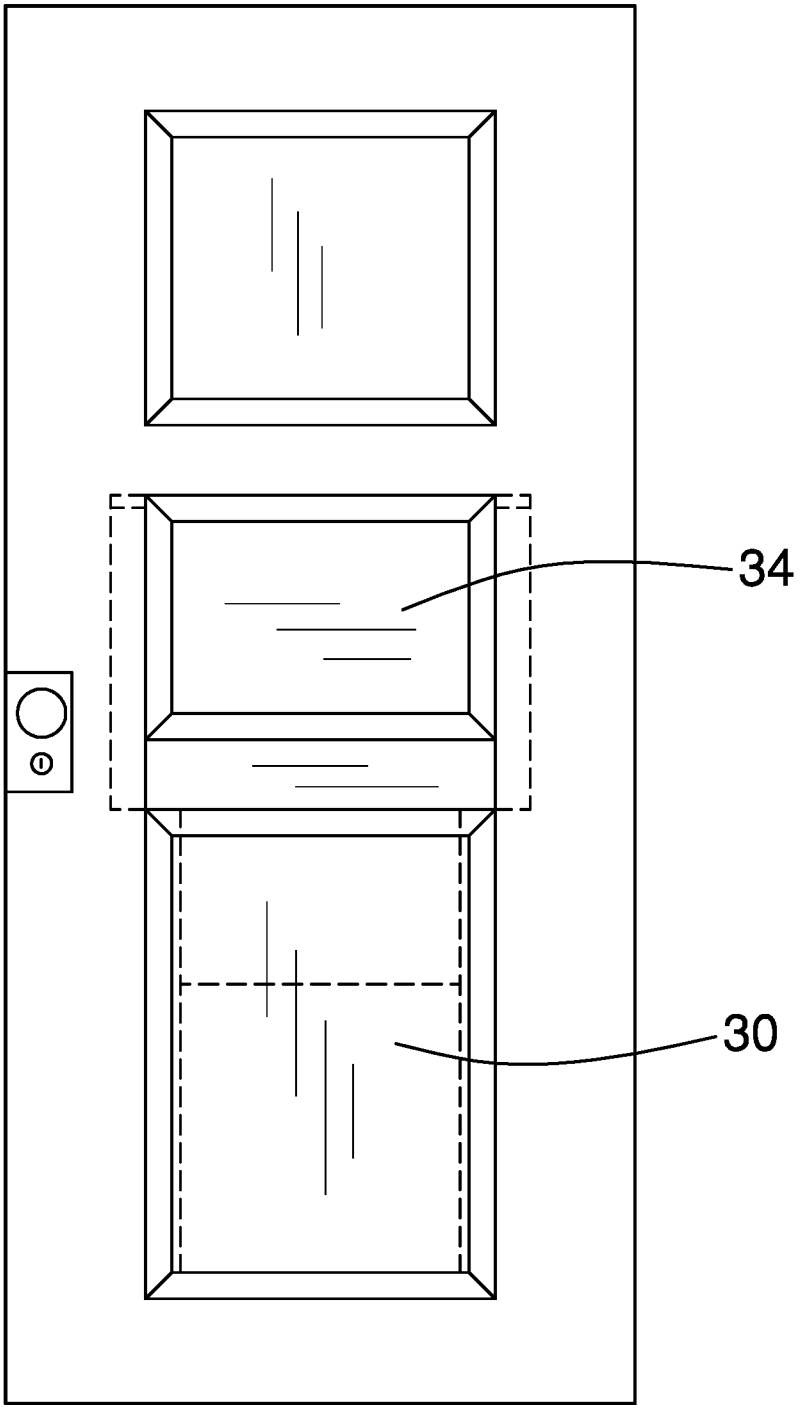
FIG. 5 is a front view of an embodiment of the disclosure.
Figure 6:
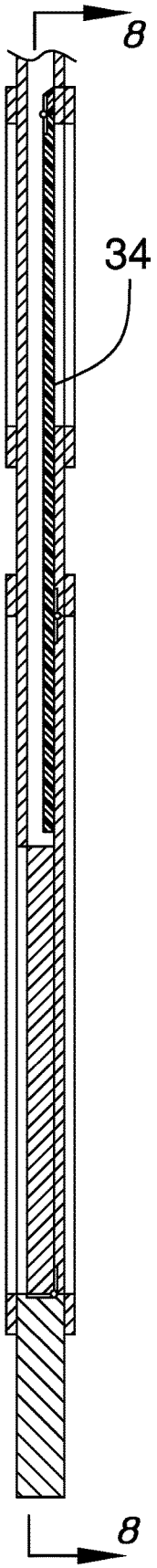
FIG. 6 is a cross-sectional view taken along line 6-6 of FIG. 1 of an embodiment of the disclosure.

A linkage 38 is attached to the closing panel 34 and the lower panel 30. The linkage 38 lowers the closing panel 34 to the closed position as the lower panel 30 is moved to the angled position and lifts the closing panel 34 to the open position as the lower panel 30 is moved to the vertical position. For example, as the linkage 38 is moved to a receiving condition, the lower panel 30 is angled outwardly as shown in FIG. 2 and the closing panel 34 closes the opening as best viewed in FIG. 7. The package 70 is then placed on the lower panel 30 so that it slides down the lower panel 30 and abuts the closing panel 34. As the linkage 38 is moved to a closed position, the closing panel 30 begins to lift to allow the package 70 to slide under the closing panel 30, through the opening 18, and into the dwelling.

The linkage 38 may comprise a linking panel 40 that has a first edge 42 and a second edge 44 disposed distal to each other. The first edge 42 is pivotally coupled to the lower panel 30 adjacent to a top edge 31 of the lower panel 30 and the second edge 44 is pivotally coupled to the closing panel 34 adjacent to an upper edge 35 of the closing panel 34. The linking panel 40 has an aperture 46 extending therethrough configured to receive the package 70 to be placed on the lower panel 30 when the lower panel 30 in the angled position. As can be seen in FIG. 2, the package 70 may be positioned through the aperture 46 and onto the lower panel 30. However, it should be understood that the linkage 38 may include a single arm or a pair of laterally spaced arms extending between the lower panel 30 and the closing panel 34. In such an embodiment, the arm may be attached to the closing panel 34 such that the closing panel is positioned between the front 14 and back 16 sides of the door 12 when the linkage 38 is in the closed position. In such an instance the front orifice 46 would not be needed. As can be seen in the Figures, if the front orifice 46 is utilized, the closing panel 34 may form part of the front side 14 of the door 12. Additionally, each of the front orifice 46 and the opening 18 may be bounded on the front side 14 of the door with a border to conceal and make aesthetically pleasing the covering 28 and the components thereof.

More specifically with respect to the above, the lower panel 30 has an interior face 48 facing the door 12, and/or opening 18, when the lower panel 30 is in the vertical position. The interior face 48 and the front side 14 of the door 12 forms an angle between 30° and 75° when the lower panel 30 in the angled position and the opening 18 is covered by the closing panel 34. This provides an adequate angle for the package 70 to slide toward the opening 18. The lower panel 30, the closing panel 34, the linking panel 40, and the door 12 each lie in a vertical plane when the lower panel 30 is in the vertical position. Thus, to a casual observer, the assembly 10 appears as a conventional door. Though not shown, a handle may be attached to the linkage 38 to assist in actuating the linkage 38. However, the handle may be positioned on the linking panel 40 or the lower panel 30.

Figure 8:
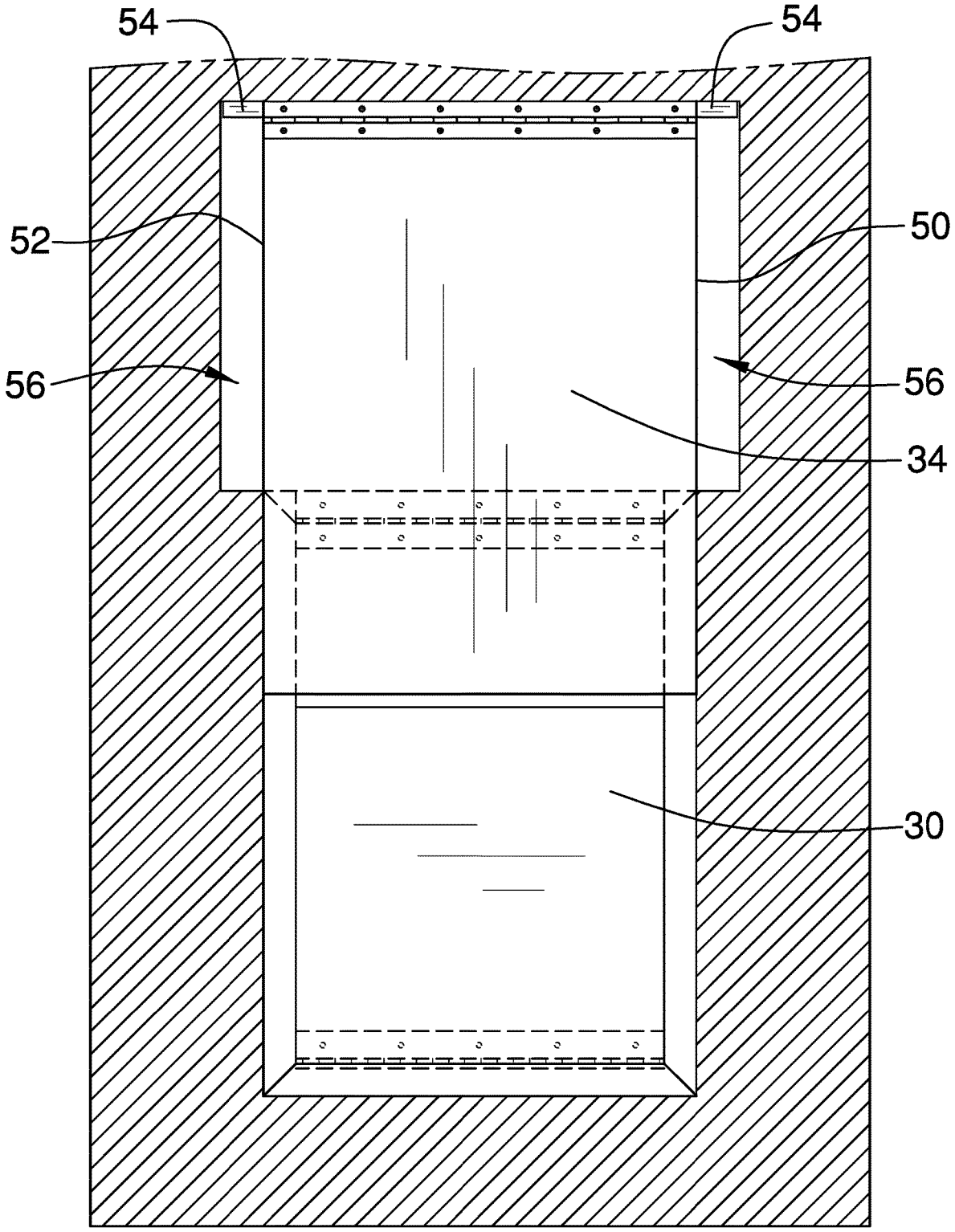
FIG. 8 is a cross-sectional view of an embodiment of the disclosure taken along line 8-8 of FIG. 6.

Further with respect to the above, the linking panel 40 has a first lateral edge 50 and a second lateral edge 52. A pair of guide pins 54 is attached to the linking panel 40 such that the first 50 and second 52 lateral edges each have one of the guide pins 54 attached thereto. The guide pins 54 are positioned adjacent to the second edge 44. The guide pins 50 are positioned in vertical guides 56 positioned in the door 12 to retain the second edge 44 adjacent to the front side 14 of the door 12 as the closing panel 34 moves between the open and closed positions. As can be seen in FIG. 8, the guide pins 54 move up and down within the vertical guides 56 to keep the linking panel 40 attached to the door 12 as its second edge 44 vertically moves relative to the opening 18.

In use, the door 12 is used in a conventional manner to restrict access to a space within a dwelling. However, when a package 70 is to be delivered to the dwelling, the package currier may actuate the linkage 38 so that the lower panel 30 is angled outwardly from the door 12 to receive the package 70. As the lower panel 30 is angled the closing panel 34 closes the opening 18 to prevent access to the interior of the dwelling as well as to inhibit the stealing of any mail or packages which may adjacent to the back side 16 of the door 12. While the lower panel 30 is moved back to a vertical orientation, the closing panel 34 lifts to allow the package 70 to fall through the opening 18 and into the dwelling.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A package pass-through assembly for an entryway, the assembly comprising:

a door having a front side and a back side, the door having an opening extending therein extending through the front and back sides, the opening having an upper edge, a lower edge, a first side edge and a second side edge;

a covering being attached to the door to close the opening, the covering including:

a lower panel being pivotally coupled to the door adjacent to the lower edge, the lower panel being positionable in a vertical position covering the opening or in an angled position exposing the opening, the lower panel being angled to form a chute for sliding packages down the lower panel and through the opening when the lower panel is in the angled position;

a closing panel being slidably attached to the door and being downwardly movable to a closed position covering the opening or upwardly movable to an open position exposing the opening; and a linkage being attached to the closing panel and the lower panel, the linkage lowering the closing panel to the closed position as the lower panel is moved to the angled position and lifting the closing panel to the open position as the lower panel is moved to the vertical position.

2. The package pass-through assembly according to claim 1, wherein the linkage comprises a linking panel having a first edge and a second edge disposed distal to each other, the first edge being pivotally coupled to the lower panel adjacent to a top edge of the lower panel, the second edge being pivotally coupled to the closing panel adjacent to an upper edge of the closing panel.

3. The package pass-through assembly according to claim 2, wherein the linking panel has an aperture extending therethrough configured to receive a package to placed on the lower panel when the lower panel in the angled position.

4. The package pass-through assembly according to claim 3, wherein the lower panel has an interior face facing the door when the lower panel is in the vertical position, the interior face and the front side of the door forming an angle between 30° and 75° when the lower panel in the angled position and the opening is covered by the closing panel.

5. The package pass-through assembly according to claim 4, wherein the lower panel, the closing panel, the linking panel, and the door each lie in a vertical plane when the lower panel is in the vertical position.

6. The package pass-through assembly according to claim 5, wherein the linking panel having a first lateral edge and a second lateral edge, a pair of guide pins being attached to the linking panel such that the first and second lateral edges each have one of the guide pins attached thereto, the guide pins being positioned adjacent to the second edge, the guide pins each being positioned in vertical guides positioned in the door to retain the second edge adjacent to the front side of the door as the closing panel moves between the open and closed positions.

7. The package pass-through assembly according to claim 1, wherein the lower panel has an interior face facing the door when the lower panel is in the vertical position, the interior face and the front side of the door forming an angle between 30° and 75° when the lower panel in the angled position and the opening is covered by the closing panel.

8. The package pass-through assembly according to claim 2, wherein the lower panel, the closing panel, the linking panel, and the door each lie in a vertical plane when the lower panel is in the vertical position.

9. The package pass-through assembly according to claim 2, wherein the linking panel having a first lateral edge and a second lateral edge, a pair of guide pins being attached to the linking panel such that the first and second lateral edges each have one of the guide pins attached thereto, the guide pins being positioned adjacent to the second edge, the guide pins each being positioned in vertical guides positioned in the door to retain the second edge adjacent to the front side of the door as the closing panel moves between the open and closed positions.

* * * * *